United States Patent [19]

Dean et al.

[11] 4,125,646

[45] Nov. 14, 1978

[54] DIFFUSION COATING OF MAGNESIUM IN METAL SUBSTRATES

[75] Inventors: Michael F. Dean; Roy L. Blize, both of San Antonio, Tex.

[73] Assignee: Chromalloy American Corporation, West Nyack, N.Y.

[21] Appl. No.: 783,396

[22] Filed: Mar. 31, 1977

Related U.S. Application Data

[62] Division of Ser. No. 635,619, Nov. 26, 1975, Pat. No. 4,036,602.

[51] Int. Cl.[2] ..... C23C 9/02

[52] U.S. Cl. ..... 427/253; 427/344; 427/372 B; 427/383 D; 427/405; 427/419 B; 427/437; 427/438

[58] Field of Search ..... 427/431, 432, 252, 253, 427/383 D, 344, 372 B, 405, 419 B, 437, 438; 428/621, 649

[56] References Cited

U.S. PATENT DOCUMENTS

| | | | |
|---|---|---|---|
| 2,912,346 | 11/1959 | Kanter | 427/431 X |
| 3,066,392 | 12/1962 | Kanter et al. | 428/649 |
| 3,748,172 | 7/1973 | Speirs et al. | 148/31.5 X |

*Primary Examiner*—Ralph S. Kendall

*Attorney, Agent, or Firm*—Hopgood, Calimafde, Kalil, Blaustein and Lieberman

[57] ABSTRACT

A protective sacrificial coating is provided for metal substrates, e.g. ferrous metal substrates, such as compressor discs or blades for jet engines, the sacrificial coating comprising an intermetallic compound of magnesium with a coating metal, the coating being anodic to the substrate metal, the coating being optionally covered with an adherent non-metallic overcoat of, for example, a conversion coating.

25 Claims, 2 Drawing Figures

MAGNESIUM NICKEL COATING PRODUCED FROM ELECTROLESS HYPOPHOSPHITE NICKEL

COATING PRODUCED FROM ELECTROLESS DIMETHYLAMINE BORANE NICKEL

DIFFUSION COATING OF MAGNESIUM IN METAL SUBSTRATES

Figure 1:
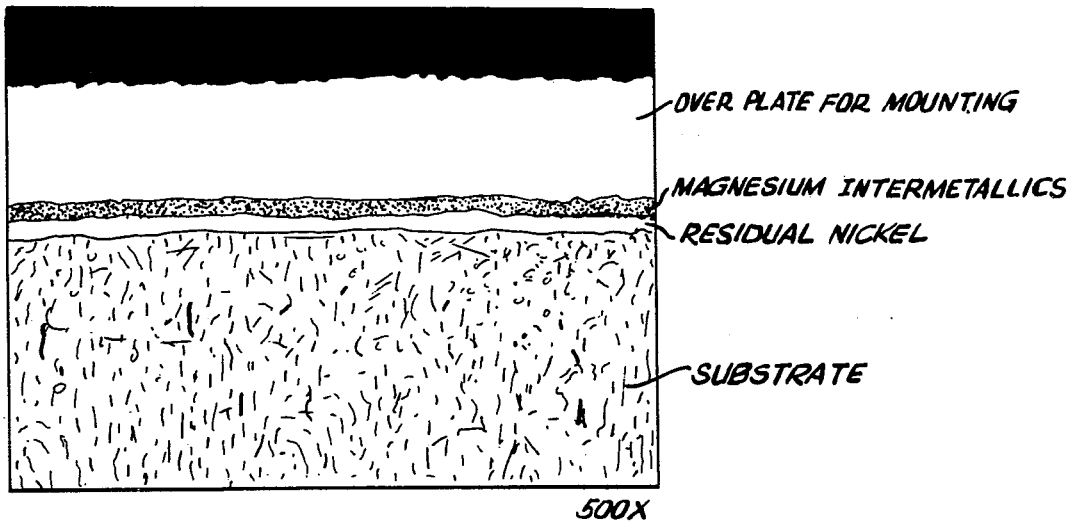

This is a division of copending application Ser. No. 635,619 filed Nov. 26, 1975, now U.S. Pat. No. 4,036,602.

This invention relates to the protection of metal substrates, such as ferrous and non-ferrous metals, from corrosion in highly saline and/or marine atmospheres and other corrosive environments.

FIELD OF THE INVENTION

Jet and gas turbine engine compresor components, for example, discs and blades, are subject to corrosion in highly saline atmosphere at the air intake end of the engine and also to direct impact of abrasive particulate matter, such as coral dust. Additionally, compressor discs and blades among other components are subjected to tremendous mechanical stresses from centrifugal forces, thermal shock, vibration and other sources of stresses. Thus, corrosion can accelerate catastrophic failure, since pits and other corrosion defects can act as stress raisers.

High strength ferrous alloys are employed in the construction of compressor discs, spacers, blades and other aircraft engine components (e.g. Society of Automotive Engineers alloy designation AMS 6304, SAE 4340, AMS 5508, AMS 5613, AMS 5616, and others) but, because of their low resistance to saline corrosion, they are generally subjected to a protective surface treatment. One, in particular, is the provision of an aluminum-base diffusion coating on the ferrous substrate by pack-aluminizing at coating temperature ranging up to 1000° F (538° C) and preferably not higher so as to avoid undesired crystallographic or metallurgical changes in the substrate during coating, which might have an adverse or undesired effect on the mechanical properties of the parts. While such coatings provide advantageous oxidation and erosion resistance and minimize the production of pulverous corrosion products on alloys, such as AMS 5616 (12% chromium steel), they are not sufficiently anodic with respect to low alloy steel substrates, such as AMS 6304 (less than 3% chromium and less than 1% nickel), to offer the desired sacrificial or anodic protection thereof against saline corrosion.

A sacrificial coating previously developed based on the presence of magnesium as an essential ingredient of the coating is disclosed in U.S. Pat. No. 3,748,172. The coating was produced by first depositing a silicate layer (e.g. sodium silicate) onto the metal substrate and the silicate coated metal substrate then subjected to pack diffusion in a pack containing alumina, coarse magnesium powder and an energizing agent, such as a halide salt (e.g. $AlCl_3$, $NH_4I$, etc.). During pack diffusion at say 900° F (483° C), a coating reaction product is formed containing magnesium, silicon and oxygen, a substantial portion of the coating containing magnesium silicide. The sacrificial coating also had an amorphous inorganic conversion layer as an overcoat.

While this coating had desirable sacrificial properties, it had certain physical and mechanical property limitations. For example, coating thickness was limited to less than 0.0005 inch. In addition, the coating was in effect a particulate mixture consisting of relatively soft inert phase (magnesium oxide) and a relatively hard reactive phase (magnesium silicide). Thus, this type of structure did not provide the desired resistance to erosion and wear. Moreover, the application of the silicate coating prior to pack diffusion with magnesium was rather inflexible since it required highly controlled spray and dipping techniques together with the curing step such that it tended to affect the overall rate of coating production.

We have now developed a new series of magnesium-based coatings that offers significant improvements over existing coatings. The coatings are genuine diffusion coatings comprised of continuous magnesium intermellic phases. This feature at the outset differentiates the coating of the invention from the prior magnesium-based coating referred to hereinabove which as stated is based on a particulate mixture formed by an exchange reaction and not by solid state diffusion of the type obtained with the present invention.

OBJECTS OF THE INVENTION

It is thus the object of this invention to provide a sacrificial coating for the protection of metal substrates, such as ferrous metal substrates.

Another object is to provide a method for further enhancing the corrosion resistance of ferrous and non-ferrous metal substrates, particularly steel substrates.

A still further oject is to provide a duplex coating comprising a sacrificial coating of a magnesium-containing alloy in combination with a special barrier type non-metallic overcoat, such as a cured silicate coating and/or a conversion coating.

These and other objects will more clearly appear when taken in conjunction with the following disclosure and the accompanying drawings.

THE DRAWINGS

Figure 2:
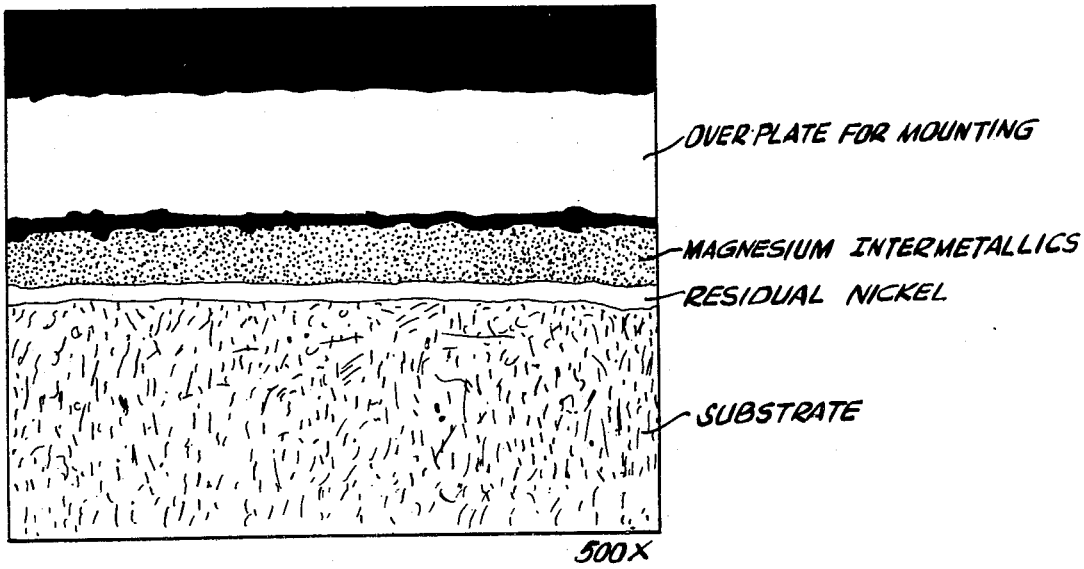

FIGS. 1 and 2 are representations of photomicrographs taken at 500 times magnification illustrating a particular sacrificial coating based on the system magnesium-nickel without the non-metallic overcoat.

STATEMENT OF THE INVENTION

One embodiment of the invention resides in a method of protecting a metal substrate against the corrosive effects of saline, marine and other corrosive environments. The metal substrate of interest is first coated with a magmesium-reacting matrix metal selected from the group consisting of silver, copper, nickel, cobalt, cerium, silicon, tin and zinc which is capable of forming an intermetallic compound with magnesium.

Following the application of the metal coating, magnesium is then thermally diffused into the metal coating to form a sacrificial coating anodic to the metal substrate comprising at least one magnesium-containing intermetallic compound bonded to the metal substrate.

A non-metallic layer may then be applied to the sacrificial coating as an overcoat comprising a solution of soluble silicate salt selected from the group consisting of sodium silicate, potassium silicate, lithium silicate and ethyl silicate which is dried and then cured at a temperature of about 150° C to 430° C. In a preferred embodiment, a conversion coating is applied to the cured silicate layer using a solution containing phosphoric acid, chromic acid and at least one chromate and phosphate-forming metal, such as aluminum and/or magnesium which is thermally cured (about 150° C to 500° C) to provide in effect a duplex coating, that is to say, a sacrificial coating of a magnesium-containing alloy and a glassy non-metallic overcoat.

Preferably, the sacrificial coating is produced by a magnesium pack diffusion process, by means of which magnesium is thermally diffused into the selected coating matrix. The coating is sacrificial to all steels and also to some aluminum alloys. It is corrosion resistant, oxidation resistant, abrasion resistant, substantially uniformly applicable over complex geometries and also can be deposited over a thickness range of about 0.0001 to 0.005 inch (i.e. from 0.1 to 5 mils).

A particularly preferred coating is the system magnesium-nickel. First, a nickel coating is applied by any suitable method, such as by electroplating, electroless plating, and the like. We prefer electroless plating since this method enables the consistent production of a uniform nickel layer on the surface of a complex shape.

In the case of certain other elements such as silicon, cerium, etc., these can be plated using gas plating techniques, for example, by transfer to the metal substrate from a halide vapor of the metal, this method being a very well known method. One method in particular is referred to in the art as "siliconizing". A still further method is a vacuum plating method from the vapor of the coating metal of interest.

DETAILS OF THE INVENTION

The Invention will now be described with respect to a preferred embodiment using nickel as the basis coating metal forming a magnesium-nickel intermetallic sacrificial coating. Although both electroplated and electroless nickel deposits have been successfully employed to make the desired nickel basis coating, the electroless deposits are preferred as stated hereinabove because of the more uniform coatings obtainable on complex geometries.

In this connection, reference is made to FIG. 1 which is a representation of a photomicrograph taken at 500 times magnification showing a relatively thin magnesium-nickel sacrificial diffusion coating (0.0002 inch) formed by using hypophosphite reduced electroless nickel, while FIG. 2 is an example of a relatively thick coating (0.0009 inch) formed using a dimethylamine borane reduced electroless nickel. The preferred method is electroless hypophosphite nickel using a low phosphorus bath to produce coatings similar to the type illustrated in FIG. 1.

The thickness of the diffused magnesium intermetallic layer can be controlled by varying the pack diffusion process parameters, time and temperature. Sacrificial intermetallic coatings have been produced as thin as 0.0001 inch and as thick as 0.002 inch; however, these thicknesses are not limiting. For example, sacrificial coatings of up to about 0.005 inch can be produced. In addition to the variable intermetallic coating thicknesses, there may be a residual reactive matrix metal layer (e.g. nickel) remaining after forming the intermetallic coating which may range from about less than 0.0001 and up to about 0.005 inch. However, the nickel or other metal coating may be completely consumed in forming the sacrificial coating with magnesium. Thus, a residual matrix metal layer is not necessary in carrying out the invention. However, a residual layer of nickel is preferred as its presence assures a uniform and strong bonding of the sacrificial coating to the metal substrate. For this purpose, the residual nickel or other reactive metal coating may preferably have a thickness of at least 0.0001 inch and range up to about 0.002 inch.

A preferred nickel matrix or coating is low phosphorus nickel which provides excellent adhesion after formation of the magnesium-nickel intermetallic sacrificial coating without requiring the presence of residual nickel after pack diffusion. This is demonstrated by the fact that substantially no spalling occurred when steel strip coated with the ultimate sacrificial coating (strip thickness about 0.05 inch) could be bent 180° over a ¼ inch diameter mandrel.

As illustrative of the invention, the following example is given:

EXAMPLE 1

An AMS 6304 low alloy steel part or substrate, such as a compressor disc, is generally degreased by chemical cleaning, if necessary, and then mechanically cleaned by grit blasting with 220 mesh silicon carbide powder at a pressure of 40 psig and a distance of about 6 to 12 inches from the steel workpiece prior to nickel plating.

Prior to applying the nickel coating, the clean part is subjected to an activation step comprising immersing the part in a 50% by volume hydrochloric acid solution for about two minutes to activate the surface. The part is then rinsed to remove any adhering HCl residue and placed immediately into a dimethylamine borane electroless nickel plating bath of the following composition:

20 grams/liter nickel sulfate ($NiSO_4.6H_2O$)
10 grams/liter citric acid monohydrate
25 mil/liter conc. HCl
$NH_4OH$ Add to raise pH to 7
2.5 to 3 grams/liter Dimethylamine Borane (DMAB)
0.5 to 2 mg/liter 2-Mercaptobenzothiazole (MBT)
15 mg/liter Sodium Lauryl Sulfate
Temperature — 100° F The citric acid is employed as a complexing agent, DMAB as a reducer, the MBT as a stabilizer and the Sodium Lauryl Sulfate as an antipitting agent.

The part is maintained in the electroless plating bath for one hour to provide a thickness of about 0.0005 inch (from which the ultimate coating of FIG. 2 was produced). After removal from the plating bath, the part is rinsed and oven dried at 400° F (205° C) for about 30 minutes.

In preparing the nickel-plated part for pack diffusion, the part is grit blasted with 320 mesh $Al_2O_3$ powder at 20 psig at a distance of from about 6 to 12 inches to remove the sheen from the outer surface of the nickel plate and obtain a matte finish.

Thereafter, the part together with other parts similarly prepared is packed in a steel retort containing approximately a 50—50 mix by weight of minus 20 to plus 40 mesh magnesium powder and 28 to 40 mesh of $Al_2O_3$ (U.S. Standard Screen) that has been previously energized with approximately 3% by weight of $NH_4Cl$.

The retort is closed substantially airtight, except for allowing gases to escape therefrom during pack diffusion, and then placed in an oven and the temperature of the retort brought up to about 875° F (470° C) for a time of about 48 hours to produce the sacrificial coating shown in FIG. 2. The temperature employed is below the melting point of magnesium.

The coated parts are removed from the retort and then subjected to oxide removal treatment by dipping in an approximate 30% by weight chromic acid solution for a time ranging up to three minutes, the parts being thereafter water rinsed and oven dried at 400° F (205° C) for 30 minutes.

The cleaned parts are then provided with a potassium silicate sealing coat by spraying the outside surface of the diffusion coated parts at ambient temperature with a 25% by volume potassium silicate solution (formed from a 29.8 Be solution) followed by drying and oven curing at a temperature of about 400° F (205° C) for 30 minutes. The thus-treated part is then subjected to a subsequent dip in a 10% by volume potassium silicate solution (also from 29.8 Be solution) consisting of three dips, with an air blow off after each dip to remove excess solution. This is then followed by a second spray application of said 25% potassium silicate solution. After the latter treatment, the parts are oven cured at 400° F (205° C) for 30 minutes following which the temperature is raised slowly to 750° F (400° C) for five minutes. The 29.8 Be potassium silicate solution has a weight ratio of $SiO_2/K_2O$ of 2.5:1 and contains 8.3 % $K_2O$ and 20.8% $SiO_2$.

Following the curing of the silicate coating, a conversion coating is optionally applied by spraying three applications of an aluminum phosphate-chromate solution, with each application receiving a subsequent oven cure at 750° F (400° C) for 30 minutes. This provides a hard glass overcoat on the parts.

The conversion coating solution is a water soluble aluminum phosphate-chromate glass. The solution is prepared, for example, by mixing the following ingredients in the proportions stated to produce about 7 to 7.5 liters for spraying:

1 liter of $Al(PO_3)_3$ solution containing 30% $P_2O_5$ and 7% $Al_2O_3$
160 grams of $CrO_3$
6 liters of water Conversion solutions are selected to provide conversion coatings following curing which generally contain the equivalent of about 10% to 15% $Al_2O_3$, about 50% to 75% $P_2O_5$ and 5% to 40% $Cr_2O_3$.

Abrasion and Erosion Properties

The magnesium-nickel sacrificial coating is capable of withstanding a temperature of about 800° F (427° C) and exhibits markedly improved resistance to abrasion and low angle erosion. The final coating is corrosion resistant and sacrificial to low alloy steels and resists oxidation up to temperatures of about 800° F (427° C). It is resistant to engine cleaners and preservatives.

As stated hereinbefore, both the reactive matrix metal coating and the magnesium intermetallic layer cover complex shapes uniformly. Where the surfaces being coated have pits, the coating provides a leveling effect, since the coating grows outward from the original surface of the substrate.

Magnesium intermetallic compounds have a hardness ranging from about 400 to 550 HV (Hardness Vickers using 50 gram loading), the residual reactive matrix metal having a hardness ranging from about 650 to 900 HV. As will be evident, this is somewhat harder than the hardness of a typical tempered steel.

SURFACE AND APPEARANCE

As with most diffusion coating processes, the final coating generally reproduces the original substrate surface texture. However, the final coating provides a general smoothing effect. When the original substrate surface has a smoothness corresponding to a RMS value of 60 microinches or less (root mean square), post coat RMS values of 20 to 30 are readily obtainable. Where the surface smoothness of the original substrate exceeds a RMS value of 60, an average drop of 30 RMS units can generally be expected after coating.

The coating has a mottled gray color that can be treated to produce a glassy surface. For example, a conversion system top coat can be employed to provide a uniform color.

COATING DENSITY

A study of the magnesium-nickel sacrificing coating of various thicknesses revealed a small range of coating densities, the density decreasing as the thickness increased as shown in Table 1 as follows:

Table 1

| Total Coating Thickness (Mils) | Density (grs/cm$^3$) | Wt % Mg |
|---|---|---|
| 0.5 | 3.25 | 42.04 |
| 0.8 | 3.01 | 44.67 |
| 1.2 | 2.96 | 46.12 |
| 1.6 | 2.85 | 46.94 |

The percentage of magnesium was determined as the average composition of the magnesium-nickel intermetallic by electron microprobe analyses. Elevated temperatures and/or extended pack times used to obtain a thicker coating favor a higher percentage of magnesium in the coating which result in low density.

The sacrificial magnesium-nickel layer may contain from about 15% to 60% by weight magnesium, for example, about 20% to 50%.

The reactive nickel layer produced by a hypophosphite bath prior to reaction with magnesium in forming the sacrificial coating may contain up to about 15% by weight of phosphorus and preferably not exceeding 8%, a low phosphorus nickel being preferred.

MECHANICAL PROPERTIES

The magnesium-nickel sacrificial coating exhibits good resistance to abrasion. This has been confirmed using a Taber Abraser and a range of test parameters simulating moderate to heavy abrasion conditions.

The Taber Abraser test is a well known test in which an abrasive wheel is brought down against the surface to be tested at various loads (Note page 626, first and second columns, ASM Metals Handbook, Vol. II, 8th Edition, 1964, in which reference is made to Method 6192 in Federal Test Method Standards No. 141.). The flat surface of the specimen is rotated during the abrasion test.

Table 2 sets forth the wear resistance of the magnesium-nickel coating compared to the wear resistance of several substrate materials and prior coatings. The higher the number of cycles per mil thickness, the better the abrasion resistance. The wheel load on the materials tested was 1000 grains.

Table 2

WEAR RESISTANCE - TABER ABRASER

| Material | Wheel CS-10, Cycles/Mil | Wheel H-38, Cycles/Mil |
|---|---|---|
| Steels: | | |
| AISI 1018 | 26,000 | 580 |
| SAE 4130 | 16,000 | 1000 |
| AMS 5508 | 26,000 | 910 |
| Coatings: | | |
| Mg/Ni | 36,000 | 1430 |
| Iron Aluminide | 33,000 | — |
| Cadmium | 9,000 | — |
| Particulate Coating (Mg-Si-O) | 10,000 | — |

As will be apparent, the Mg/Ni coating of the invention gave the best results of all the materials tested.

Erosion resistance measured as a function of angle impingement using a Roberts Jet Abrader with 50 micron $Al_2O_3$ flowing at 5 grams/minute and accelerated with a pressure of 45 psig at a distance from the surface of the workpiece of 0.6 inch indicated that the magnesium-nickel intermetallic sacrificial coating exhibited adequate resistance to erosion. The Jet Abrader is described in Test Method 6193 of Federal Test Method Standard No. 141A.

FATIGUE ENDURANCE

Fatigue endurance strengths determined for specimens coated in accordance with the invention showed that the coating does not materially decrease the fatigue strength, depending on the thickness of the residual reactive matrix metal coating. Several different tests were employed. In one test, rotating beam fatigue bars of AMS 6304 and AISI 4340 were employed in the uncoated condition, with a thin residual nickel coating (less than 0.0003 inch) and also a thick residual nickel coating (more than 0.0003 inch). Resonant frequency flexural fatigue tests were conducted in a cantilever mode on the coated specimens using brazed joints in one test regime and individual forged stator vanes of a steel referred to as Jethete in another test regime. The results of these tests are summarized in Table 3 below.

Table 3

Fatigue Endurance Strength Comparison Between Uncoated and Mg/Ni Coated Materials

| | Uncoated | Thin Residual Ni | Thick Residual Ni |
|---|---|---|---|
| Rotating Beam - ksi at $10^7$ Cycles | | | |
| AMS 6304 | 100 | 95 | 75 |
| AISI 4340 | 95 | 90 | 80 |
| Flexural Fatigue of Vanes - ksi at $10^7$ Cycles | | | |
| New Jethete* | 65 | 55 | 50 |
| Used Jethete* | 55 | 55 | 45 |
| Flexural Fatigue of Brazed Joints - ksi at $10^7$ Cycles | | | |
| AMS 4772 Brazed Stator Segment | 32 | — | 32 |

*Jethete comprises 12% Cr, 1.25% max Ni, 1.25% max Mn, 0.6% max Si, 1% max Mo, 1% Cb and balance Fe As will be noted, the thin residual Ni coating (thickness of about 0.0002 inch) sustains fatigue better than the thicker coating (thickness about 0.0004 inch).

It should be noted that reduction in fatigue can also be minimized by shot peening the coated surface. It appears that the origin of the fatigue reduction is related to high stress residual nickel. Peening the nickel after an over-aging heat treatment at 800° F (427° C) for about 1 hour aids in recovering fatigue strength. Thus, fatigue results using new Jethete samples prepared in this manner (that is, peening) exhibited a fatigue endurance strength of 60 ksi, even with a residual nickel coating of 0.0004 inch. There was no reduction of fatigue strength of brazed assemblies due to thick magnesium-nickel sacrificial coatings.

TENSILE AND STRESS RUPTURE PROPERTIES

Tests were conducted on the magnesium-nickel system coating on AMS 5616 which were compared with uncoated specimens. The results are given in Tables 4 and 5 below.

Table 4

Tensile Strength Comparison Between Uncoated and Mg/Ni Coated AMS 5616

| | Y.S. (KSI) | UTS (KSI) | R.A. | Elongation |
|---|---|---|---|---|
| Uncoated | 118 | 145 | 60% | 19% |
| Mg/Ni Coated | 122 | 145 | 57% | 18% |

Table 5

Stress Rupture Comparison Between Uncoated and Mg/Ni Coated AMS 5616 at 700° F

| | Failure Stress | Hours to Failure | R.A. | Elongation |
|---|---|---|---|---|
| Uncoated | 120 ksi | 21 | 59% | 11.8% |
| Mg/Ni Coated | 120 ksi | 19 | 61% | 11.4% |
| Mg/Ni Coated | 115 ksi | 90 | 60% | (Ave. 4 tests) |

The bare sample and the first coated sample were originally stressed at 90 ksi for 100 hours. The stress on each sample was raised to 110 ksi for an additional 50 hours, after which the stress was further increased to 120 ksi until failure occurred as noted. Multiple tests were conducted on coated samples at a stress of 115 ksi with an average failure time as indicated. As will be noted, the coating does not adversely affect the strength properties.

THE SACRIFICIAL COATING

The constituents of the coating have been identified by X-ray diffraction, microprobe and chemical analyses. The most desirable magnesium-nickel sacrificial coating is one containing low phosphorus using a hypophosphite electroless nickel plating bath. Regular hypophosphite and dimethylamine borane electroless nickel, as well as electroplate nickel, have been successfully employed.

Magnesium diffusion into the hypophosphite nickel produces primarily the intermetallic compound $Mg_2Ni$ which melts at about 760° C and contains about 46% magnesium, the coating also containing minor amounts of $MgNi_2$ and $Mg_3P_2$. The deposited hypophosphite nickel is approximately 95% Ni and 5% P, and any residual unreacted nickel remaining below the Mg-Ni sacrificial coating will have the same composition. The sacrificial coating nominally contains approximately 45% Mg, 52% Ni and 3% P.

In its broad aspects, the sacrificial coating may contain about 15% to 60% magnesium and generally 20% to 50% magnesium. The hypophosphite nickel deposit may generally contain up to about 15% and preferably not exceeding 8%, e.g. 6% or less.

The generation of the coating during pack diffusion results in an approximate 2.5 to 1 growth from the thickness of the nickel involved in the intermetallic. Nickel per se has a density of about 8.9 grams/$cm_3$. Thus, when magnesium diffuses into the nickel, the resulting intermetallic compound has a much lower density which results in a volume change (growth). Generally speaking, the compositional distribution of the constituents across the thickness of the sacrificial intermetallic layer is substantially uniform.

OXIDATION AND CORROSION PROPERTIES

Optimum resistance to the environment is achieved by applying an amorphous inorganic conversion top coat. This top coat system provides a non-sticking glossy surface that retains conductivity for sacrificial protection but which retards general coating dissolution.

A preferred coating is a layer of silicate, such as potassium silicate which, as stated earlier, is applied by spraying or dipping and then cured. Following the curing of the silicate coating, a conversion coating of aluminum phosphate-chromate glass is applied as a water soluble system and cured at 850° F (455° C) which imparts a greenish hue to the coatings. The top coat or overcoat typically ranges in thickness from about 0.00005 to 0.0002 inch and generally not exceeding 0.0001 inch.

Various comparative corrosion tests have been conducted with the coating, including both qualitative and quantitative comparisons to other coating systems.

For example, open circuit EMF measurements with reference to a saturated calomel electrode were made in 1M NaCl solutions. According to Table 6, the results show the coating to fall between pure aluminum and the Mg-Si-O System coatings, and potentially offer sacrificial protection to any material listed above the magnesium-nickel electromotive force. Open circuit EMF measurements are only qualitative, at best, in assessing sacrificial corrosion behavior. Substantially more quantitative determinations, using galvanic corrosion couples, were made to further characterize the coating. Two corrosion rate determinations were made with various galvanic corrosion couples. One was based on the natural sacrificial galvanic current flow, as measured using essentially short circuited members connected through a zero resistance ammeter circuit which is determined by calculation using Faraday's Law. The second corrosion rate determination was based on actual weight loss of each of the galvanic couple members after the completion of the galvanic test. The results are presented in Table 7. All reported tests were conducted in 1M NaCl solution at room temperature.

Tables 6 and 7 are as follows:

Table 6

OPEN CIRCUIT EMF VERSUS SCE IN 1M NaCl at R.T.

| MATERIAL | E(mv) VERSUS SCE* |
|---|---|
| Titanium | −260 |
| 400 Stainless Steel | −250 to −550 |
| Low Alloy Steel | −420 to −650 |
| Iron Aluminide | −660 |
| Aluminum power/paint system | −770 |
| Aluminum | −780 |
| Magnesium-Nickel Coating | −850 |
| Mg-Si-O** | −950 |
| Magnesium | −1600 |

*Saturated Calomel Electrode
**This is the particulate coating mentioned herein containing magnesium silicide.

Table 7

CORROSION RATE DETERMINATIONS FOR GALVANIC CORROSION COUPLES IN 1M NaCl at 25° C

| Couple | Galvanic Corrosion Rate (mpy)* | Weight Loss Corrosion Rate (mpy)* |
|---|---|---|
| 1. Low Alloy Steel | 8 | 30 |
| Inconel 600 | — | — |
| 2. Low Alloy Steel | 15 | 37 |
| ALSI 410 | — | — |
| 3. Low Alloy Steel | 1 | 23 |
| Iron Aluminide Coated AISI 410 | — | — |
| 4. Low Alloy Steel | — | — |
| Magnesium-Nickel Coating of the Invention | 40 | 38 |
| 5. Low Alloy Steel | — | — |
| Sprayed Aluminum Paint Powder | 36 | 25 |
| 6. Low Alloy Steel | — | 19 |
| Mg-Si-O** | 1 | 1 |

Table 7-continued

CORROSION RATE DETERMINATIONS FOR GALVANIC CORROSION COUPLES IN 1M NaCl at 25° C

| Couple | Galvanic Corrosion Rate (mpy)* | Weight Loss Corrosion Rate (mpy)* |
|---|---|---|
| 7. Magnesium-Nickel | 3 | 10 |
| Inco 600 | — | — |
| 8. Magnesium-Nickel | 4 | 9 |
| Iron Aluminide Coated AISI 410 | — | 2 |

*Mils per year.
**This is the particulate coating referred to herein containing magnesium silicide.

Since an anticipated application for the coating would be corrosion and/or galvanic cell protection of low alloy jet engine compressor case materials, galvanic corrosion measurements include combinations with these materials. It can be seen from these data that the coating provides excellent sacrificial protection to the low alloy steel.

Numerous qualitative and semi-quantitative environmental resistance tests have been conducted on the coating. These tests usually include coated hardward samples (low alloy steel case pieces) with stator vane materials installed. Various exposure scheme combinations have been employed, including salt spray, elevated temperature (400° F - 900° F or 205° C - 483° C), and immersion or washing in preservatives, engine cleaners or water. The coatings have invariably provided superior performance in comparative tests, usually addressed to general resistance, and contact material compatibility.

A salt spray test commonly employed in determining the sacrificial properties of coatings is a procedure outlined in ASTM B 117-64.

The ASTM salt spray test (Designation B 117-64) employed in testing the resistance to corrosion of the various coating systems disclosed herein comprises a fog chamber, a salt solution reservoir, a supply of suitably conditioned compressed air, one or more fog nozzles, specimen supports, provisions for heating the chamber and control means. The specimens are supported or suspended between 15 and 30 degrees from the vertical (out of contact with each other) and preferably parallel to the principal direction of horizontal flow of fog through the chamber. The salt solution is made up of 5±1 parts of salt to 95 parts of distilled water containing not more than 200 ppm, of total solids. The condensed fog should have a pH of 6.5 to 7.2. The temperature within the chamber is maintained at 95° F plus 2° or minus 3° F. For the specimens in this case, the salt spray testing is carried out for a period stated herein, precautions being taken to avoid dripping of condensed solution from one specimen to another.

In using the test to evaluate the quality of the sacrificial coating, specimens comprising ½ inch cylinder or 1 inch strip of the substrate are employed. In the case of the strip, a section of the coating is abraded from the specimen to be tested. In the case of the cylindrical specimen, one edge is bevelled by abrasion on a belt or grinding wheel to expose the substrate. The specimens with the partially exposed substrate are then subjected to the aforementioned ASTM salt spray test. The sacrificial coating gave excellent results after 500 hours of testing as evidenced by the complete freedom of substrate deterioration.

Very good protection has even been observed after exposure of the coated part at 900° F (482° C) followed by the salt spray test. However, the coating is more effective at temperatures up to 805° F (455° C). Excellent salt spray protection has been obtained after exposure at temperatures up to 800° F (427° C).

Examples of the production of other sacrificial coatings are as follows:

EXAMPLE 2

A steel part (AMS 6304) is coated with a sacrificial coating by first cleaning the substrate and then plating it with copper at a thickness of about 0.0007 inch by using the following electroless plating bath:

Copper sulfate; 20 g/l
Sodium carbonate; 25 g/l
Rochelle salt; 140 g/l
Versene-T; 17 g/l
Sodium hydroxide; 40 g/l
Formaldehyde (37%); 150 g/l
pH; 11.5
Temperature; 70° F Following approximately one hour of plating, the copper coated substrate is rinsed and dried and then prepared for pack diffusion by grit blasting with 320 mesh $Al_2O_3$ powder as in Example 1.

Thereafter the part is embedded in a pack in a steel retort containing a 50—50 mix by weight of minus 20 to plus 40 mesh magnesium powder and 28 to 48 mesh $Al_2O_3$. The pack prior to embedding the part therein is first energized with approximately 3% by weight of $NH_4Cl$ by subjecting the pack to burn-out at about 800° F (427° C). The retort, with the part embedded in the pack is placed in an oven and heated to 700° F (370° C) and held at temperature for about 24 hours.

A magnesium-copper intermetallic is formed as the sacrificial coating. The coated part is cleaned as in Example 1 and similarly provided with a cured silicate substrate and thereafter an aluminum phosphate-chromate conversion top coat which is then cured at about 450° C.

EXAMPLE 3

A steel part (SAE 4340) is coated with zinc at a thickness of about 0.0005 inch by embedding the part in a pack contained in a steel retort, the pack composition comprising about 20% by weight of zinc (minus 100 mesh to plus 325 mesh) mixed with 80% by weight of $Al_2O_3$ (28 to 48 mesh) to which pack is also added about 0.5% by weight of area. The retort is heated to a temperature of about 650° F (343° C) for about 20 hours. This produces a coating on the steel substrate enriched in zinc, the coating being partially diffused into the steel surface and comprising about 70% to 80% by weight of zinc.

Following the production of the zinc coating, the part is cleaned by honing the surface with 325 mesh $Al_2O_3$ at a pressure not exceeding about 40 psig and the cleaned part then embedded in a magnesium-$Al_2O_3$ pack as in Example 2 in a steel retort and the zinc-coated steel part subjected to pack diffusion at a temperature of about 800° to 850° F (425° C to 455° C) for about 20 hours to produce a sacrificial coating comprised of a magnesium-zinc intermetallic compound.

Following the formation of the sacrificial coating, the part is cleaned as in Examples 1 and 2 and then provided with a cured sodium silicate coating and a top coat of a cured coating of aluminum phosphate-chromate salt formed over the cured silicate coating as described herein.

PACK DIFFUSION PROCESS

As stated herein, the magnesium in the pack may range by weight from about 5 to 95% (e.g. 40 to 60%), the refractory diluent up to about 95% by weight (e.g. 60 to 40%), and the halide energizer in small but effective amounts, such as from about ¼% to 5% by weight of the total weight of the pack. The pack prior to use in a magnesium diffusion cycle is first subjected to burn-out at 700° F (370° C) to 930° F (510° C) to condition it. The halide energizer may comprise metal and ammoniacal halides and halide formers, such as iodine. Examples of halides are $NH_4Cl$, $NH_4F$, $NH_4I$, $NH_4Br$ and $AlCl_3$, among others. The particle size of the magnesium powder may range from about 325 mesh up to minus 20 mesh (U.S. Standard Screen), such as minus 20 to plus 40 mesh powder.

The alumina is used in the pack as an inert diluent. Besides alumina, other inert and temperature stable diluents can be employed, such as zirconia, titania, hafnia, thoria, rare earth oxides, silicon carbide, titanium carbide, tungsten carbide, and the like. The inert diluent employed is generally refractory in nature and has a melting point above 1300° C. The particle size may similarly range from above 325 mesh to minus 20 mesh, such as 28 to 49 mesh.

The temperature during pack diffusion is maintained below the melting point of magnesium and generally ranges from about 700° F (370° C) to 1000° F (540° C), preferably about 750° F (400° C) to 900° F (483° C).

NON-METALLIC COATING

While a wide range of silicate solutions can be employed in producing the silicate coat, potassium silicate is preferred. Thus, in a spray-dip-spray system, the first spray coating on the metal part is preferably produced from a potassium silicate solution containing by weight about 1 to 3% $K_2O$ and about 2.5 to 7.5% $SiO_2$ which is then dried and cured. The thus-coated part is then dip coated in a potassium silicate solution containing by weight about 0.3 to 0.75% $K_2O$ and about 0.75 to 2.5% $SiO_2$ which is dried and cured. Then a final spray coat is applied using the first stated solution above followed by drying and curing. The coating steps prior to curing are carried out at temperatures up to 100° C.

Sodium silicate solutions may be employed. A preferred solution for producing a uniform precoat on the sacrificial coating is one containing by weight 0.05 to 2% $SiO_2$ equivalent, for example, a soluble silicate in the form of $Na_2O.3.22\ SiO_2$. Other solutions which may be employed are lithium silicate and organic silicates, such as ethyl silicate.

The life of the silicated sacrificial magnesium-nickel coating is further enhanced by the application of a conversion coating from a solution in substantially the manner in which the silicate coating is applied. A preferred aqueous conversion coating solution is one ranging by weight from about 5% to 30% phosphoric acid (preferably 10% to 30%), one or more of the metals comprising about 0.0235% to 3% aluminum and/or 0.75% to 6% magnesium, 3% to 8% chromic acid ($CrO_3$), and the balance essentially water.

After conversion coating the cured silicated ferrous metal parts, the parts are dried and cured in an oven which heats the metal surface to a temperature of 850° F (450° C). The parts are then cooled prior to the next application depending upon the conversion coating cycle being employed.

The application of the conversion coating as described above results in a smooth uniform layer which provides oxidation-corrosion protection without the need for supplementary surface finishing. A build-up of approximately 0.1 mil can be obtained by employing a plurality of silicate and conversion coating applications.

It will be appreciated that, in addition to the conversion coating formulation described herein, various conversion coatings of the phosphate-chromate types may be employed in conjunction with the soluble silicate salt. Stating it broadly, the conversion coating comprises phosphates and chromates of at least one metal, for example, Al, Mg, Zn, Be, Ba, Sr, Ce-group metals and other metals.

As illustrative of other conversion formulations, the following examples are given:

A phosphate-chromate solution X of beryllium is produced by starting with 200 ml of 85% phosphoric acid (1.6 grams/ml) which is diluted with water to a pH of 1.01. To the solution is added 62.5 grams of chromic acid (99% $CrO_3$) and 40 grs of beryllium phosphate ($Be_3(PO_4)_2$). This solution has a density of about 1.2 grams/milliter and provides a conversion coating by spraying the solution onto the coated surface and curing at temperatures ranging from 300° F (150° C) to 800° F or 900° F (427° C - 482° C), the spraying and curing being repeated about three times or more, if necessary.

The foregoing solution may be used as a base to which other soluble metal salts or compounds can be added. A preferred formulation is to add 0.69 gram of the other metal salt or compound to 120 grams of solution X. The following series of conversion solutions are illustrative of the various types of solutions that can be made:

(1) 0.69 gram of magnesium chromate dissolved in 120 grams of solution X at a pH of 1.8.
(2) 0.69 gram of magnesium phosphate dissolved in 120 grams of solution X at a pH of 1.3.
(3) 0.69 gram of aluminum phosphate dissolved in 120 grams of solution X at a pH of 2.
(4) 0.69 gram of $Ba(OH)_2 \cdot 3H_2O$) dissolved in 120 grams of solution X at a pH of 1.8.
(5) 0.69 gram of $Ce_2(CO_3)$. $5H_2O$ dissolved in 120 grams of solution X at a pH of 1.9.
(6) 0.69 gram of $Ce(PO_3)_3$ dissolved in 120 grams of solution X at a pH of 1.4.

Sprayed coatings produced from the foregoing solutions and then dried and cured on a steel substrate exhibited satisfactory conversion coating properties when subjected to a series of oxidation and salt spray cycles.

PLATING SOLUTIONS

As has been stated hereinbefore, various techniques may be employed to produce a layer of a magnesium-reacting matrix metal on the metal substrate.

An electroless nickel plating solution which may be employed is as follows:

Nickel Sulfate; 15 to 30 gpl
Sodium Hypophosphite; 15 to 30 gpl
Sodium Glycolate; 20 to 40 gpl
Sodium Succinate; 10 to 20 gpl
The pH is adjusted to 4.5 to 6.
The temperature is preferably 180°-195° F.

A tupical aqueous solution is one containing 25 gpl nickel sulfate, 25 gpl sodium hypophosphite, 30 gpl sodium glycolate and 17 gpl sodium succinate.

Another electroless solution for plating copper comprises:

170 grams/liter Rochelle Salts
20 grams/liter Sodium Hydroxide
35 grams/liter Copper Sulfate ($CuSO_4.5H_2O$)

Many plating solutions are available in the art and need not be repeated here, such as are found in the Guide Book and Directory for Metal Finishing (1973) published by Metals and Plastics Publications, Inc., Westwood, N.J.

As is clearly apparent from the foregoing disclosure, one embodiment of the invention is directed to an article of manufacture comprising a metal substrate, such as a ferrous metal article, characterized by a sacrificial thermally diffused coating bonded to said substrate comprising at least one intermetallic compound of magnesium with magnesium-reacting matrix metal from the group consisting of silver, copper, nickel, cobalt, cerium, silicon, tin and zinc, said sacrificial coating being anodic to said metal substrate. Preferably, the sacrificial coating has bonded thereto a cured non-metallic barrier layer formed from a silicate selected from the group consisting of sodium silicate, potassium silicate, lithium silicate and ethyl silicate. In a more preferred embodiment, a conversion coating is applied to the silicate layer, the conversion coating comprising a metal phosphate-chromate salt, such as an aluminum phosphate-chromate salt.

In another embodiment of the invention, the residual layer of reactive matrix metal in the final coating may range in thickness from less than 0.0001 inch to 0.005 inch, with the sacrificial layer bonded thereto and having a thickness ranging from about 0.0001 to 0.005 inch. In the case of the magnesiium-nickel sacrificial layer, the amount of magnesium may range from 15% to 60% by weight and usually 20% to 50%.

As regards the reactive metals silver, copper, nickel, cobalt, cerium, silicon, tin and zinc, the intermetallic compounds formed with magnesium by thermal diffusion which wll appear as the sacrificial coating include MgAg, $Mg_3Ag$; $MgCu_2$, $Mg_2Cu$; $MgNi_2$, $Mg_2Ni$; $Mg_3Ce$, $Mg_2Ce$, MgCe, etc.; $Mg_2Si$; $Mg_2Sn$; and $MgZn_3$, MgZn, , MgZn, $MgZn_2$, etc. Generally speaking, most of the compounds contain magnesium falling in the range of about 15% to 60% by weight, with a substantial number falling in the range of about 20% to 50% by weight. As will be appreciated, when using a hypophosphite or a dimethylamine borane — containing solution, compounds of the systems Mg-P Mg-B may be present.

Although the present invention has been described in conjunction with preferred embodimemts, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method of protecting a metal substrate against corrosive environments which comprises, coating said metal substraate with a magnesium-reacting matrix metal selected from the group consisting of silver, copper, nickel, cobalt, cerium, silicon, tin and zinc capable of forming at least one intermetallic compound with magnesium which is anodic relative to the metal substrate, embedding said metal substrate in a magnesium-containing pack, and then pack diffusing magnesium into the coating of said substrate at an elevated diffusion temperature below the melting point of magnesium, thereby forming said intermetallic compound, whereby an adherent sacrificial coating is produced anodic to said metal substrate comprising said at least one intermetallic compound bonded to said metal substrate.

2. A method of protecting a metal substrate against the corrosive effects of saline and marine environment which comprises, coating said metal substrate with a magnesium-reacting matrix metal selected from the group consisting of silver, cooper, nickel, cobalt, cerium, silicon, tin and zinc capable of forming at least one intermetallic compound with magnesium which is anodic relative to the metal substrate, embedding said metal substrate in a magnesium-containing pack, pack diffusing magnesium into the coating of said substrate at an elevated diffusion temperature below the melting point of magnesium, thereby forming said intermetallic compound, whereby an adherent sacrificial coating is produced anodic to said metal substrate comprising said at least one intermetallic compound bonded to said metal substrate, applying to said sacrificial coating a non-metallic coating of a solution of soluble silicate salt selected from the group consisting of sodium silicate, potassium silicate, lithium silicate and ethyl silicate at a temperature ranging up to 100° C, and drying and curing said non-metallic layer on said metal coating, the curing of said non-metallic coating being carried out at a temperature of about 150° C to 430° C.

3. The method of claim 1, wherein said step of applying said silicate layer is repeated a plurality of times and dried, and wherein the applied layers are thereafter cured by heating to said temperature of 150° C to 430° C.

4. The method of claim 3, wherein following the formation of the cured slicate coating, a conversion coating is applied by means of a solution containing by weight about 5% to 30% phosphoric acid, about 3% to 8% chromic acid ($CrO_3$), and at least 0.5% of at least one chromate and phosphate-forming metal and the balance essentially water, drying said conversion coating and then thermally curing said conversion coating.

5. The method of claim 4, wherein said chromate and phosphate-forming metal is at least one of the metals aluminum in an amount of 0.02% to 3% and magnesium in an amount of 0.75% to 6%.

6. A method of protecting a metal substrate against the corrosive effects of saline and marine environments which comprises, coating said metal substrate with a layer of nickel, embedding said metal substrate in a magnesium-containing pack, pack diffusing magnesium into the coating of said substrate at an elevated diffusion temperature below the melting point of magnesium to form a sacrificial coating comprising at least one magnesium-nickel intermetallic compound which is anodic relative to said substrate, applying to said sacrificial coating a non-metallic coating of a solution of soluble silicate salt selected from the group consisting of sodium silicate, potassium silicate, lithium silicate and ethyl silicate at a temperarture ranging up to 100° C, and drying and curing said non-metallic layer on said metal coating, the curing of said non-metallic coating being carried out at a temperature of about 150° C to 430° C.

7. The method of claim 6, wherein said step of applying said silicate layer is repeated a plurality of times and dried, and wherein the applied layers are thereafter cured by heating to said temperature of 150° C to 430° C.

8. The method of claim 7, wherein following the formation of the cured silicate coating, a conversion coating is applied by means of a solution containing by weight about 5% to 30% phosphoric acid, about 3% to 8% chromic acid ($CrO_3$), and at least 0.5% of at least one chromate and phosphate-forming metal and the balance essentially water, drying said conversion coating and then thermally curing said conversion coating.

9. The method of claim 8, wherein said chromate and phosphate-forming metal is at least one of the metals aluminum in an amount of 0.02% to 3% and magnesium in an amount of 0.75% to 6%.

10. The method of claim 8, wherein the coating formed by the diffusion of magnesium into said nickel layer comprises in cross section a residual layer of nickel bonded to the substrate ranging in thickness from less than 0.0001 to 0.005 inch and a sacrificial coating layer of said magnesium-nickel intermetallic compound bonded to said residual layer ranging in thickness from about 0.0001 to 0.005 inch.

11. The method of claim 10, wherein said chromate and phosphate-forming metal is at least one of the metals aluminum in an amount of 0.02% to 3% and magnesium in an amount of 0.75% to 6%.

12. The method of claim 11, wherein said conversion coating has a thickness ranging from about 0.00005 to 0.0002 inch.

13. A method of protecting a metal substrate against the corrosive effects of saline and marine environments which comprises, coating said metal substrate with nickel by electroless plating said substrate in an electroless plating solution, subjecting said nickel coated substrate to a pack diffusion process at an elevated diffusion temperature comprising embedding said substrate in a magnesium-containing pack and heating said pack at said elevated diffusion temperature below the melting point of magnesium to effect the transfer of magnesium into the nickel coating on said substrate and thereby produce at least one intermetallic compound of magnesium-nickel in the form of a sacrificial coating, applying to said sacrificial coating a non-metallic coating of a solution of soluble silicate salt selected from the group consisting of sodium silicate, potassium silicate, lithium silicate and ethyl silicate at a temperature ranging up to 100° C, and drying and curing said non-metallic layer on said metal coating, said curing being carried out at a temperature of about 150° C to 430° C.

14. The method of claim 13, wherein said step of applying said silicate layer is repeated a plurality of times and dried, and wherein the applied layers are thereafter cured by heating at a temperature of 150° C to 430° C.

15. The method of claim 14, wherein following the formation of the cured silicate coating, a conversion coating is applied by means of a solution containing by weight about 5% to 30% phosphoric acid, about 3% to 8% chromic acid ($CrO_3$), and at least 0.5% of at least one chromate and phosphate-forming metal and the balance essentially water, drying said conversion coating and then thermally curing said conversion coating.

16. The method of claim 15, wherein said chromate and phosphate-forming metal is at least one of the metals aluminum in an amount of 0.02% to 3% and magnesium in an amount of 0.75% to 6%.

17. The method of claim 13, wherein the coating formed by the diffusion of magnesium into said nickel layer comprises in cross section a residual layer of nickel bonded to the substrate ranging in thicknss from less than 0.0001 to 0.005 inch and a sacrificial coating layer of said magnesium-nickel intermetallic compound bonded to said residual layer ranging in thickness from about 0.0001 to 0.005 inch.

18. The method of claim 17, wherein said step of applying said silicate layer is repeated a plurality of times and dried, and wherein the applied layers are thereafter cured by heating at a temperature of 150° C to 430° C.

19. The method of claim 18, wherein following the formation of the cured silicate coating, a conversion coating is applied by means of a solution containing by weight about 5% to 30% phosphoric acid, about 3% to 8% chromic acid ($CrO_3$), and at least 0.5% of at least one chromate and phosphate-forming metal and the balance essentialy water, drying said conversion coating and then thermally curing said conversion coating.

20. The method of claim 19, wherein said chromate and phosphate-forming metal is at least one of the metals aluminum in an amount of 0.02% to 3% and magnesium in an amount of 0.75% to 6%.

21. The method of claim 20, wherein said conversion coating has a thickness ranging from about 0.00005 to 0.0002 inch.

22. The method of claim 13, wherein said pack contains by weight about 5% to 95% magnesium in particulate form, about 5% to 95% by weight of a refractory diluent and a small but effective amount of a halide energizer, and wherein said pack diffusion process is carried out in a retort at a temperature in the range of about 370° C to 540° C.

23. The method of claim 22, wherein said pack contains about 40% to 60% by weight magnesium and 60% to 40% by weight of said refractory diluent.

24. The method of claim 23, wherein the substrate is ferrous metal and wherein the refractory diluent is alumina.

25. The method of claim 23, wherein the small but effective amount of the halide energizer ranges by weight from about 1/4% to 5% selected from the group consisting of $NH_4Cl$, $NH_4F$, $NH_4I$, $NH_4Br$ and $AlCl_3$.

* * * * *